United States Patent [19]

Browning et al.

[11] 4,016,414

[45] Apr. 5, 1977

[54] WRITING DEVICE INCORPORATING ILLUMINATING MEANS

[76] Inventors: Scott M. Browning, 3269 Polk Ave., Ogden, Utah 84403; Gregory F. Klomp, 2500 Fillmore, Ogden, Utah 84401

[22] Filed: Apr. 9, 1975

[21] Appl. No.: 566,370

[52] U.S. Cl. ..... 240/6.46; 401/192

[51] Int. Cl.² ..... F21V 33/00; B43K 29/10

[58] Field of Search ..... 240/6.46, 6.4 R, 10.68, 240/10 A; 401/195, 192, 216, 212; 200/195 B, 264, 86 R

[56] References Cited

UNITED STATES PATENTS

| | | | |
|---|---|---|---|
| 1,875,048 | 8/1932 | Levene | 240/6.46 X |
| 2,368,839 | 2/1945 | Jansen | 240/6.46 X |
| 2,467,608 | 4/1949 | Bischof | 240/6.46 X |
| 2,641,670 | 6/1953 | Graves, Jr. | 200/264 |
| 2,761,057 | 8/1956 | Modell | 240/6.4 R |
| 2,954,446 | 9/1960 | Wikkerink | 200/86 R |
| 3,004,140 | 10/1961 | Gomes | 240/6.46 |
| 3,045,111 | 7/1962 | Hoenig | 240/6.46 |
| 3,095,859 | 7/1963 | Levy | 401/192 |
| 3,668,337 | 6/1972 | Sinclair | 200/159 B |
| 3,697,711 | 10/1972 | Tetrick | 200/159 B |

FOREIGN PATENTS OR APPLICATIONS

| | | | |
|---|---|---|---|
| 2,841 | 2/1891 | United Kingdom | 401/192 |
| 747,968 | 4/1956 | United Kingdom | 401/216 |

*Primary Examiner*—Edna M. O'Connor

[57] ABSTRACT

The present invention comprises a writing implement having means to provide for illumination on the writing surface concentrically about implement contact therewith. Replaceable, translucent writing cartridges are envisioned, this as well as a translucent end piece providing an aligning socket for the light bulb. Novel pressure switch means is supplied for selectively energizing the inwardly contained light means so that light illumination will be provided proximate the point of the implement.

7 Claims, 5 Drawing Figures

WRITING DEVICE INCORPORATING ILLUMINATING MEANS

The present invention relates to writing implements and, more particularly, provides a writing implement having selectively energizeable lighting means for providing illumination proximate the writing element of the implement. Specifically, the writing means in a preferred embodiment hereof supplies illumination concentrically, i.e. completely about the implement point.

In the past many types of professional people have found the need of having some type of writing implement, such as a pen or pencil, which self-illuminates a writing surface. Such a usable and practical tool would be highly useful to airline pilots, military people, doctors, hospital nurses and other aides, and so forth. Students often find lighting in lecture halls or visual display rooms inadequate for seeing properly. It would be most useful to have a practical writing implement which itself illuminates the contact area of the writing surface, be it paper, cardboard, or other means.

The present invention is believed a distinct improvement over prior devices such as those illustrated in U.S. Pat. Nos. 1,418,132 and 2,452,735. Thus, among such improvements over the prior art and devices known, are a number of concepts: the feature of having translucent replaceable cartridges such as ink-filled cartridges, the principle of having a transparent or translucent member which interiorly receives the writing cartridge and also provides a socket for enabling the proper positioning of the light without the same being screw-threaded into the structure. Other advantages inhere in the present invention, including physically closable, pressure switch means which is automatically actuated by the user taking the implement in writing position. The internal light goes off, of course, when the thumb and finger pressure is removed from the implement.

Other novel features will become apparent hereinafter.

Accordingly, a principal object of the present invention is to provide a new and improved lighting implement having self-contained illuminating means for illuminating the writing surface proximate the touch point of the implement.

A further object is to provide a writing implement having a transparent or translucent cartridge, such as an ink cartridge, which can be conveniently replaced from time to time; such cartridge is transparent or translucent for the specific purpose of allowing conduction of light immediately proximate the touch point of the implement.

A further object is to provide a writing implement having light-conducting end means which simultaneously forms both guide and socket for an enclosed bulb.

A further object is to provide improved electrically conductive means, including switching means, for a writing implement containing internal lighting means.

A further object is to provide a tactile switching means for writing implements including illuminating bulbs.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

Figures 1, 2, 3, 3A, 4:
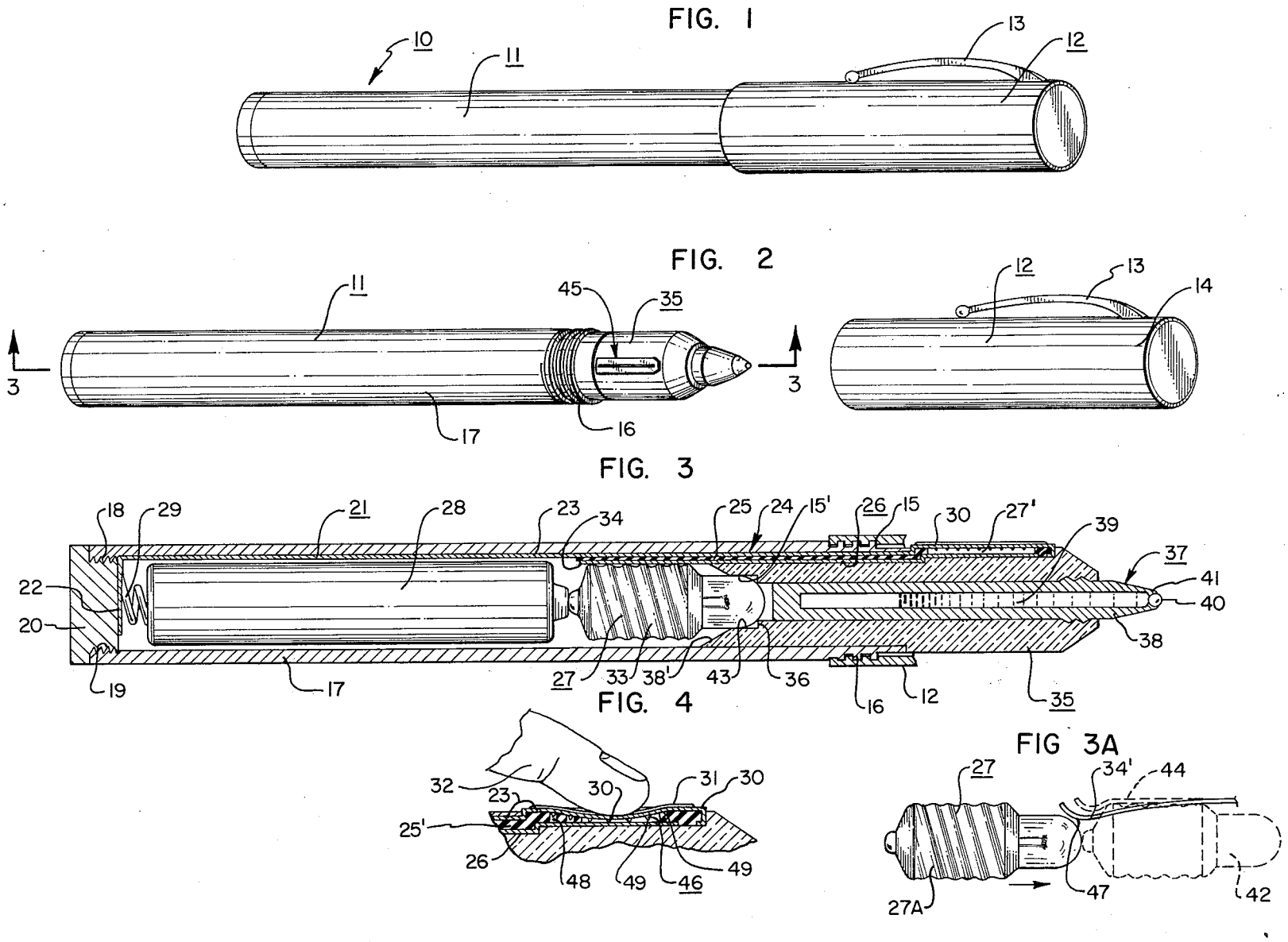
FIG. 1 is a perspective view of the writing implement of the present invention in a preferred form thereof.
FIG. 2 is similar to FIG. 1 but illustrates the cap as being removed from the writing implement proper.
FIG. 3 is an elongate cross-section of the device shown in FIG. 2.
FIG. 3A is an enlarged, fragmentary view of the central portion of the structure of FIG. 3, but wherein the conductive means is physically contoured slightly differently so as to ensure a firm electrical and physical contact of the conductive strip with the normally threaded portion of the enclosed light.
FIG. 4 is an enlarged fragmentary view of an upper forward portion of the drawing of FIG. 3 wherein the pressure switch means and its actuation are illustrated.

In the drawings the illuminated writing device of the present invention is designated by the numeral 10 and includes a writing implement 11 and also a cap 12. Cap 12 is generally cylindrical in configuration and includes a pocket clip 13 which is mounted to the cap member 14 having internal threads 15. Cap member 14 may be designed from a thin resilient plastic material such as a high density polyurethane or an acrylic plastic; the same can be inexpensively manufactured to easily encompass, by its internal threads 15, the external threads 16 of casing 17.

Casing 17 forms a portion of the writing implement 11. Casing 17 may be made of an opaque plastic or other type material, as convenient. Casing 17 includes internal threads 19 which receive a threaded metal plug or closure 20 that is threaded at 18 for mutual engagement with threads 19.

Of special importance is the inclusion of an electrically conductive strip 21, made of copper by way of example, which is configured and includes a foot at 22 and also an elongate leg at 23. The elongate leg proceeds to the right in FIG. 4 until the same forms a part of a sandwich construction 24 including leg 23, a rubber or other insulating layer or strip 25, and also an inner conductive strip 26. A gap or space 27' is provided between the inner and outer conductive strips 26 and 21, this so that the two conductors may be closed together as illustrated in FIG. 4, so that the circuit for light 27 is completed. The circuit will of course include battery 28 and along with its electrically conductive compression spring 29.

The pressure switch of the invention deserves amplification. It is seen that the same comprises the strips 21 and 26 which are separated by an insulative layer 25. If desired, one, such as outer conductive strip 21 at leg 23, may be provided with interior protuberances 46 which can aid in physically contacting and giving electrical connection with respect to inner conductive strip 26. The latter may include a dog-leg configuration as indicated in FIG. 4. The outermost conductive strip may be designed to be resilient, such as spring-tempered copper or brass material, so that upon depression the two portions of the two strips are mutually conductive, see FIG. 4, whereas upon the release of thumb or finger pressure the outermost portion 30 will spring outwardly to the condition shown in FIG. 3. If desired, there may be included a tactile rib 31 which serves simply as a finger-positioning means for the user's finger 32 so that rapid location of the switch construction at 45 in FIG. 2 can be achieved.

It is noted that portion 34 of strip 26 engages the threads 33 of light 27. Thus, a straight configuration of the conductive strip 26 at portion 34 may be used, or alternatively, the configuration at FIG. 3A can be employed wherein portion 34', corresponding to portion 34, may be curved slightly inwardly and include a bent finger portion at 47 which serves as a "feeler" for light 27. Thus, when the light is thrust forwardly to the dotted position 42 in FIG. 3A, then the inwardly curved portion of the conductive strip will spring outwardly to the dotted line configurement at 44 in FIG. 3A, thereby assuring an excellent electrical contact with the threaded portion 27A of light 27.

Of special importance is the inclusion of a translucent end piece 35 which incorporates a shoulder 36 forming a part of spherical socket 43 for the light. An annular chamfered surface forms a conical guide 38' for the light to ensure proper placement thereof. It is noted that by provision of the socket no threaded physical connection for the light need be provided interior of the implement casing; rather, the spring 29 and battery 28 combination operatively function to thrust the light forwardly into contact with socket surface 15' of its socket which, annularly contacting the bulb of the light, will axially align the light for proper electrical connection with strip 26. The translucent nature of end piece 35 provides for a ready transmission of light from light 27 through the end piece 35, longitudinally, to shine light on the writing surface over which the implement is positioned and touches.

Replaceable writing implement 37 may itself include a transparent or translucent barrel 38 suitable for receiving a charge of ink 39, pencil lead, and so forth. The tip 40 may comprise the ball as found in a conventional ballpoint pen, a felt tip, or can even constitute a pencil lead. End 41 may be shaped in manufacture to comprise a suitable seat for ball 40. What is most important in the writing implement 37 is the fact that the barrel 38 thereof is translucent or transparent to carry light radiation from light 27 proximate the tip area.

From manufacturing considerations, a Lucite plastic, an acetate, or other type of transparent or translucent material may be used to fabricate barrel 38 and end piece 35.

In operation and for storage, the cap 12 is simply threaded onto threads 16 of the barrel of writing implement 11 in the manner shown in FIG. 1. Where the cap is removed and replaced on the reverse end of writing implement 11 in a customary manner, then the writing implement can be immediately used in darkened environments as by the user closing the pressure switch formed by leg 23 of conductive strip 21 and conductive strip 26 proximate space or gap 27' as seen in FIG. 3. When finger pressure or thumb pressure is released, then the outer strip at 30 will spring outwardly so as to open the circuit between the two strips.

For convenience, rib 31 may be provided on the actuating switch as a tactile or touch indicia to ensure proper placement of the thumb or finger. Protuberance 46 will ensure proper contact with the inner conductive strip 26.

FIG. 3 illustrates that insulation layer 25' may be perforate at 48 to receive the spikes 49 of protuberance 46 or these spikes 49 may simply be pushed through the layer 25' when the latter is made of a soft rubber, for example.

What is provided, therefore, is an illuminated writing device which carries its own source of illumination. Specifically, the illumination proceeds longitudinally down the transparent or translucent end piece 35, as well as even down the translucent barrel 38 of replaceable writing cartridge 37. Finally, that end piece portion which conducts light also provides a socket for the light bulb itself at 43, so that no threaded connection is needed to secure physically the light bulb in place. Rather, battery 28 with spring 29 serve to keep the light 27 physically located correctly for proper engagement with the metallic conductive strip 26. The switch configuration is likewise important and is easily actuated through fingertip pressure in a manner indicated in FIG. 4, by way of example.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

We claim:

1. A writing device with self-contained lighting means and including, in combination: a casing having a rearward extremity, an elongate translucent end piece secured to and within said casing and having an axial bore and a light-means-receiving and positioning socket contiguous with and rearwardly disposed with respect to said bore; light means positioned within and engaging said socket for transmitting light energy forwardly through said translucent end piece; battery means disposed in said casing and operatively engaging said light means; a closure secured to said casing at said rearward extremity; a compression spring operatively interposed between said closure and said battery means; circuit means coupled to said battery means and light means for selectively supplying electrical energy from said battery means to said light means, said circuit means including manual pressure-actuated switching structure disposed proximate said end piece; and a replaceable translucent writing implement disposed in and engaging said bore and protruding forwardly of said end piece.

2. The device of claim 1 wherein said translucent end piece includes an annular, conically chamfered guide surface contiguous with said socket and facing rearwardly therefrom.

3. The device of claim 1 wherein said circuit means includes a pair of elongate electrical strips separated in part by an insulation strip, one of said electrical strips being electrically coupled to said battery means via said compression spring, said compression spring being electrically conductive, the remaining one of said electrical strips being coupled to said light means, portions of said electrical strips being free of said insulation strip in at least one region, proximate said translucent end piece, one of said conductive strips being manually accessible and resilient, whereby selective depression of said one conductive strip to engage the remaining conductive strip closes said switch structure, said switch structure being formed thereby.

4. The combination of claim 3 wherein one of said strips includes protuberance means facing the remaining strip proximate said region.

5. The combination of claim 4 wherein said insulation strip is continuous but is provided with perforations proximate and directly under said protuberance means.

6. The combination of claim 4 wherein said protuberance means includes spikes, said insulation strip being continuous but made of a material which is easily penetrable by said protuberance means' spikes.

7. The combination of claim 3 wherein a portion of said manually accessible strip is raised laterally above said translucent end piece, for tactile position-indication.

* * * * *